US009618275B1

(12) United States Patent
Anderson et al.

(10) Patent No.: US 9,618,275 B1
(45) Date of Patent: Apr. 11, 2017

(54) HYBRID HEAT PIPE

(75) Inventors: William G. Anderson, Bound Brook, NJ (US); John R. Hartenstine, Mountville, PA (US); Kyle S. Van Riper, Avondale, PA (US); Calin Tarau, Downingtown, PA (US); Christopher Peters, Olivette, MO (US)

(73) Assignee: Advanced Cooling Technologies, Inc., Lancaster, PA (US)

( * ) Notice: Subject to any disclaimer, the term of this patent is extended or adjusted under 35 U.S.C. 154(b) by 374 days.

(21) Appl. No.: 13/506,623

(22) Filed: May 3, 2012

(51) Int. Cl.
*F28D 15/04* (2006.01)

(52) U.S. Cl.
CPC ..... *F28D 15/046* (2013.01)

(58) Field of Classification Search
CPC ..... F28D 15/046
USPC ..... 165/104.26, 104.33
See application file for complete search history.

(56) References Cited

U.S. PATENT DOCUMENTS

| | | | | |
|---|---|---|---|---|
| 4,489,777 | A | 12/1984 | Del Bagno | |
| 6,915,843 | B2 | 7/2005 | Kroliczek | |
| 6,951,243 | B2 * | 10/2005 | Nilson et al. | 165/104.21 |
| 2005/0086806 | A1 * | 4/2005 | Wert | 29/890.032 |
| 2005/0126757 | A1 * | 6/2005 | Bennett | F28F 1/40 165/104.11 |
| 2005/0252643 | A1 * | 11/2005 | Kroliczek et al. | 165/104.26 |
| 2007/0240858 | A1 * | 10/2007 | Hou et al. | 165/104.26 |
| 2007/0240859 | A1 * | 10/2007 | Wang et al. | 165/104.26 |
| 2008/0105406 | A1 * | 5/2008 | Chang et al. | 165/104.26 |
| 2009/0020269 | A1 * | 1/2009 | Chang et al. | 165/104.26 |
| 2009/0308576 | A1 * | 12/2009 | Wang et al. | 165/104.26 |
| 2009/0314472 | A1 * | 12/2009 | Kim et al. | 165/104.26 |
| 2010/0108297 | A1 * | 5/2010 | Chen | 165/104.26 |
| 2010/0149755 | A1 * | 6/2010 | Tomioka et al. | 361/700 |
| 2010/0212870 | A1 * | 8/2010 | Wu et al. | 165/104.26 |
| 2010/0263833 | A1 * | 10/2010 | Lee | 165/104.26 |
| 2010/0263835 | A1 * | 10/2010 | Wang | 165/104.26 |
| 2010/0319882 | A1 * | 12/2010 | Lee et al. | 165/104.26 |
| 2010/0326631 | A1 * | 12/2010 | Hou | 165/104.26 |
| 2011/0024085 | A1 * | 2/2011 | Huang et al. | 165/104.26 |
| 2011/0100608 | A1 * | 5/2011 | Huang et al. | 165/104.26 |
| 2011/0174466 | A1 * | 7/2011 | Liu et al. | 165/104.26 |
| 2011/0192575 | A1 * | 8/2011 | Figus | 165/104.26 |
| 2011/0214841 | A1 * | 9/2011 | Huang et al. | 165/104.26 |
| 2013/0220580 | A1 * | 8/2013 | Kroliczek et al. | 165/104.26 |

* cited by examiner

*Primary Examiner* — Justin Jonaitis
*Assistant Examiner* — Joel Attey
(74) *Attorney, Agent, or Firm* — McNees Wallace & Nurick LLC

(57) ABSTRACT

A heat pipe with a capillary structure that consists of heat conductive capillary grooves in the condenser region that meet with a porous wick in the evaporator section. The embodiments include several structures of the interface at the junction of the porous wick and the capillary grooves. One such interface is a simple butt joint. Others have interlocking shapes on the wick and the grooves such as parts of the wick that fit into or around the grooves.

6 Claims, 6 Drawing Sheets

HYBRID HEAT PIPE

BACKGROUND OF THE INVENTION

This invention deals generally with heat pipes and more specifically with hybrid heat pipes which have different structures for their evaporator and condenser sections.

Grooved aluminum Constant Conductance Heat Pipes (CCHPs) are the standard heat pipes used in spacecraft thermal control. The capillary grooves, which are typically formed by extrusion, allow long heat pipes that carry high power. On the other hand, the heat pipes have several limitations:

One is that the maximum evaporator heat flux is relatively low, on the order of 5-15 W/cm$^2$. At higher heat fluxes, boiling in the evaporator grooves can disrupt the liquid return, causing the heat pipe to dry out.

Another limitation is the adverse elevation in gravity affected environments, the distance that the evaporator is elevated above the condenser. CCHPs can only operate with a small adverse elevation. They are typically tested on earth with a small adverse elevation of 0.1 inch against gravity to simulate operation in space. Straight and bent heat pipes can also operate in gravity aided mode with the condenser above the evaporator. For a bent heat pipe the evaporator can be non-level, but in this case the evaporator itself must have no more than a small adverse elevation, on the order of 0.1 inch from end to end, to allow liquid supply to the entire evaporator during startup. This requirement may not be practically satisfied for planetary landers and rovers that require a higher adverse elevation while navigating on tilted surfaces, or around rocks and holes.

Capillary grooves are the standard capillary structure used in spacecraft CCHPs, diodes, and Variable Conductance Heat Pipes. These grooves have a very high permeability, allowing very long heat pipes for operation in zero-g, typically several meters long. One of their flaws is that they are suitable only for space, or for gravity aided sections of a heat pipe. The reason is that the same large cross section dimension responsible for the high permeability results in low capillary pumping capability. In addition, axial grooved CCHPs also have a relatively low heat flux limitation.

Grooved aluminum and ammonia heat pipes are designed to work with a 0.10 inch adverse elevation in a 1-g (earth) environment. This allows them to be tested on earth prior to insertion in a spacecraft. However, they are very sensitive to adverse elevation. Increasing the adverse elevation by 0.010 inch will significantly decrease the maximum power that the heat pipe can carry. For heat pipes operating on Earth, the Moon, or Mars grooves can only be used in horizontal or gravity-aided portions of the heat pipe. Another wick with higher capillary pumping capability must be used for sections with adverse elevations.

Loop heat pipes are currently used in place of CCHPs for higher heat fluxes, or to overcome an adverse elevation. The disadvantage of loop heat pipes is that they are significantly more expensive to fabricate, and often are more difficult to start-up, sometimes requiring start-up heaters.

Problems have also been observed in the startup of vertically oriented grooved heat pipes in a gravity field where the evaporator is positioned below the condenser. In small diameter heat pipes, the fluid will accumulate in the evaporator as a liquid pool and may cause a higher thermal resistance at start up. The heat must transfer through the liquid pool, until sufficient power and superheat is applied to start boiling in the liquid. In some cases start up heaters have been used to apply a high heat flux over a small area to initiate boiling. Dual heaters are sometimes used for redundancy. These heaters require logic to initiate them, and add mass, which is undesirable in planetary exploration.

These problems can all be solved with a higher performance wick that has a smaller pore size and consequently a greater capillary pumping capability. The higher performance wick can also be more tolerant to higher heat flux, because the smaller pores are more resistant to vapor disrupting liquid flow. While it would theoretically be possible to use a higher performance porous wick throughout the heat pipe, this would significantly reduce the overall heat pipe power, since the permeability of a higher performance porous wick decreases faster than the pore size. An excessively low permeability may increase the liquid flow pressure drop to an unacceptable level, so that the heat pipe can only carry very low power.

SUMMARY OF THE INVENTION

In the present invention only the evaporator wick is replaced with a higher performance porous wick, while most of the condenser has the conventional capillary grooves. The adiabatic section of the heat pipe can contain either porous wick or capillary grooves or both.

The selection of a wick for a given heat pipe depends primarily on its pore size and permeability. Pore size determines the pumping capability of the wick, which determines the maximum capillary pressure that the wick can generate to return fluid from the condenser to the evaporator. Permeability measures the pressure drop generated when the fluid flows through the wick. The ideal heat pipe wick would have a small pore size with a high pumping capability, as well as a high permeability, so there is minimum pressure drop during liquid return. However, pore size and permeability are inversely related. Small pore size wicks have low permeability, and large pore size wicks have high permeability. The grooved heat pipe wick represents one extreme with a large pore size and large permeability.

In most heat pipes, the designer selects a single pore size and related permeability for the entire wick. In the current invention, capillary grooves are used in the condenser, and a small pore size, lower permeability porous wick is used in the evaporator. The adiabatic section, where no heat is transferred in or out of the heat pipe, can contain either or both wicks. The evaporator wick can be either fabricated in situ, or fabricated separately and slid into place. Evaporator wicks can include screen wicks, felt wicks, foam wicks, and/or sintered wicks.

One construction option is to form the evaporator wick in place, insuring a good interface with the capillary grooves. However, it is difficult to form high performance wicks in aluminum heat pipes, due to the tenacious aluminum oxide layer. Previous attempts to use a flux to remove the oxide and form sintered aluminum powder wicks have not yielded satisfactory results. Enough of the flux remains in the wick that the heat pipe gasses up during long term operation.

The solution in the present invention is to form the porous wick outside the heat pipe, and insert it into the heat pipe. One crucial factor is that the porous wick of the present invention must have good hydraulic communication with the capillary grooves to insure good liquid transfer and proper heat pipe operation. The present invention also deals with the interface between capillary grooves in the condenser and a higher performance porous wick in the evaporator.

A hybrid heat pipe with capillary grooves and a high performance porous wick provides the following advantages: the high performance evaporator wick is capable of operating at higher heat fluxes as compared to axial capillary grooves and can also operate against gravity on the planetary surface; the condenser's capillary grooves allow the heat pipe to operate in space carrying power over long distances; the condenser's capillary grooves allow the heat pipe to act as a thermosyphon on the planetary surface for Lunar and Martian landers and rovers; the combination has a higher transport capability compared to an all-sintered porous wick; and the combination will allow the use of vertical heat pipes without a startup heater while carrying higher power.

The several embodiments of the present invention are for the structure of the interface between the porous wick and the capillary grooves.

DETAILED DESCRIPTION OF THE INVENTION

Figure 1:
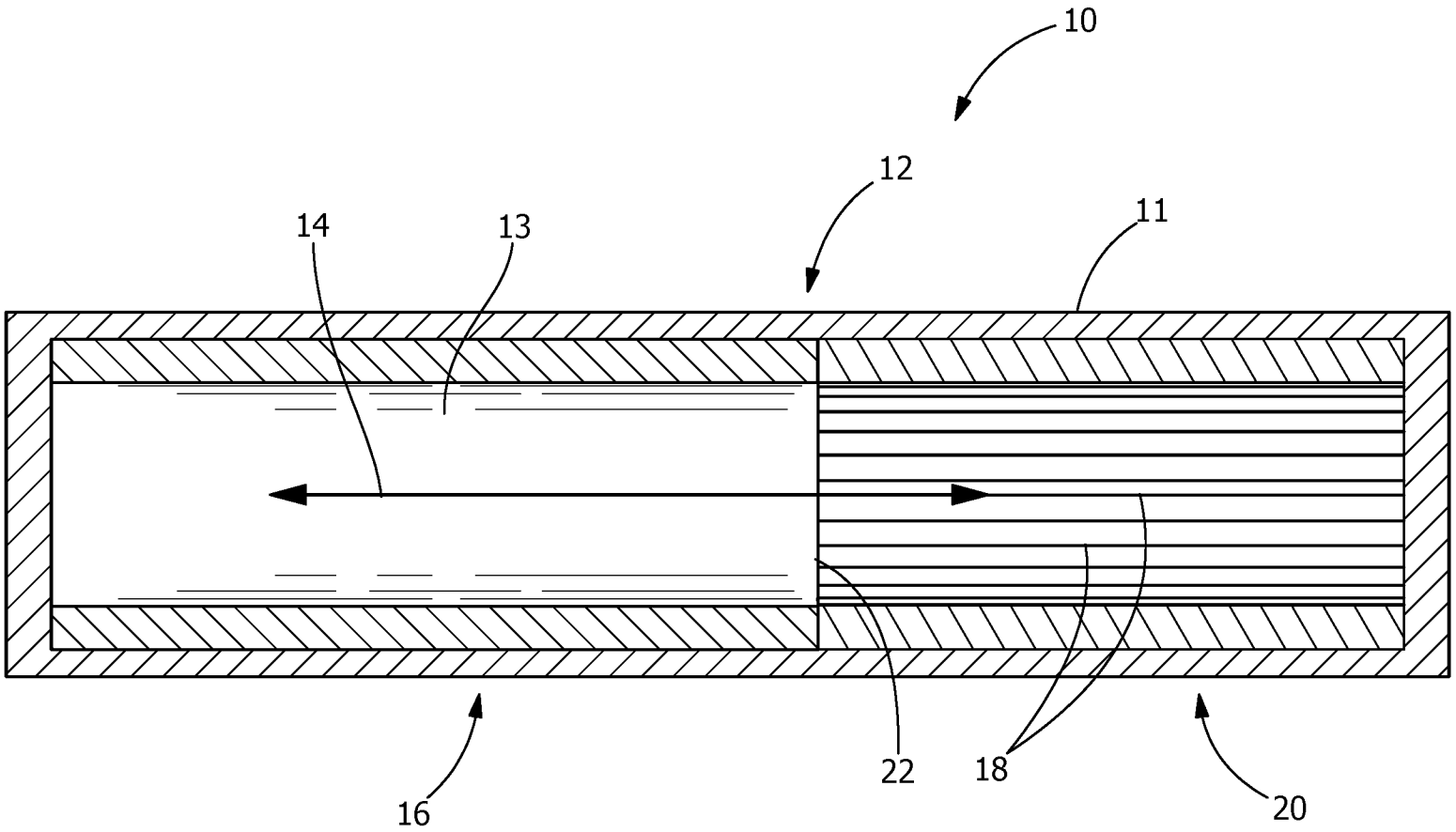
FIG. 1 is an axial cross section view of a hybrid heat pipe which is a heat conductive tube with dosed ends and an interface between a tubular porous wick in the evaporator section and capillary grooves formed in the casing wall of the condenser section, with an open vapor region through the central portion of the tube, and with the interface capable of transferring condensed liquid from the grooves to the porous wick, and in which the interface is the squared off end of the porous wick pressed against the grooves.

FIG. 1 is a cross section view of hybrid heat pipe 10 which is a pipe with closed ends. The pipe, which forms the casing of the heat pipe, is made of a heat conductive material which can be metal or some other heat conductive material such as ceramic. Interface 12 is the junction between porous wick 13 in evaporator section 16, and capillary grooves 18 formed in the casing wall of condenser section 20. Parts 11 are the walls of the outermost grooves. Interface 12 is capable of transferring condensed liquid from grooves 18 to porous wick 13, and interface 12 is squared off end 22 of porous wick 13 pressed against grooves 18. Vapor space 14 is located in the central region of heat pipe 10 and is an open passage between condenser section 20 and evaporator section 16.

The critical requirements for evaporator wick 13 are good fluid connection with capillary grooves 18 and good thermal connection with the wall of evaporator section 16. Instead of forming a higher performance wick in place, evaporator wick 13 of the present invention is formed separately, and inserted into heat pipe 10. Interface 12 between grooves 18 and porous wick 13 must be designed for good fluid connection. Good thermal connection between the wall of evaporator section 16 and porous wick 13 can be achieved with an interference fit. Heat pipe 10 is heated so that its inner diameter expands to be larger than wick 13. Once wick 13 is inserted, heat pipe 10 cools and contracts, forming a good thermal joint. An alternate method is to use a slightly oversized wick, and crush it slightly as it is inserted into heat pipe 10.

Evaporator wick 13 must be properly mated to capillary grooves 18 to allow fluid to flow from the grooves into the evaporator wick. The objective is to form an ideal joint with no gaps or voids. Theoretical calculations indicate that the joint could still function with a slight gap between grooves 18 and porous wick 13. For example, the theoretical maximum allowable gap between porous wick 13 and grooves 18 can be 0.016 inch for a specific application operating at 50° C. This calculation is based on balancing the capillary pressure generated by the geometry of the gap with the liquid, vapor, and gravity pressure drops in the heat pipe.

Several embodiments of the invention include structures of different interfaces to provide a good interface between inserted porous wick 13, and in-situ capillary grooves 18. The simplest interface is squared off end 22 of porous wick 13 pressed against grooves 18 as shown in FIG. 1. Grooves 18 are removed from the section of heat pipe 10 where porous wick 13 is to be inserted, the end of wick 13 is squared off, and then inserted into the heat pipe.

Figure 2:
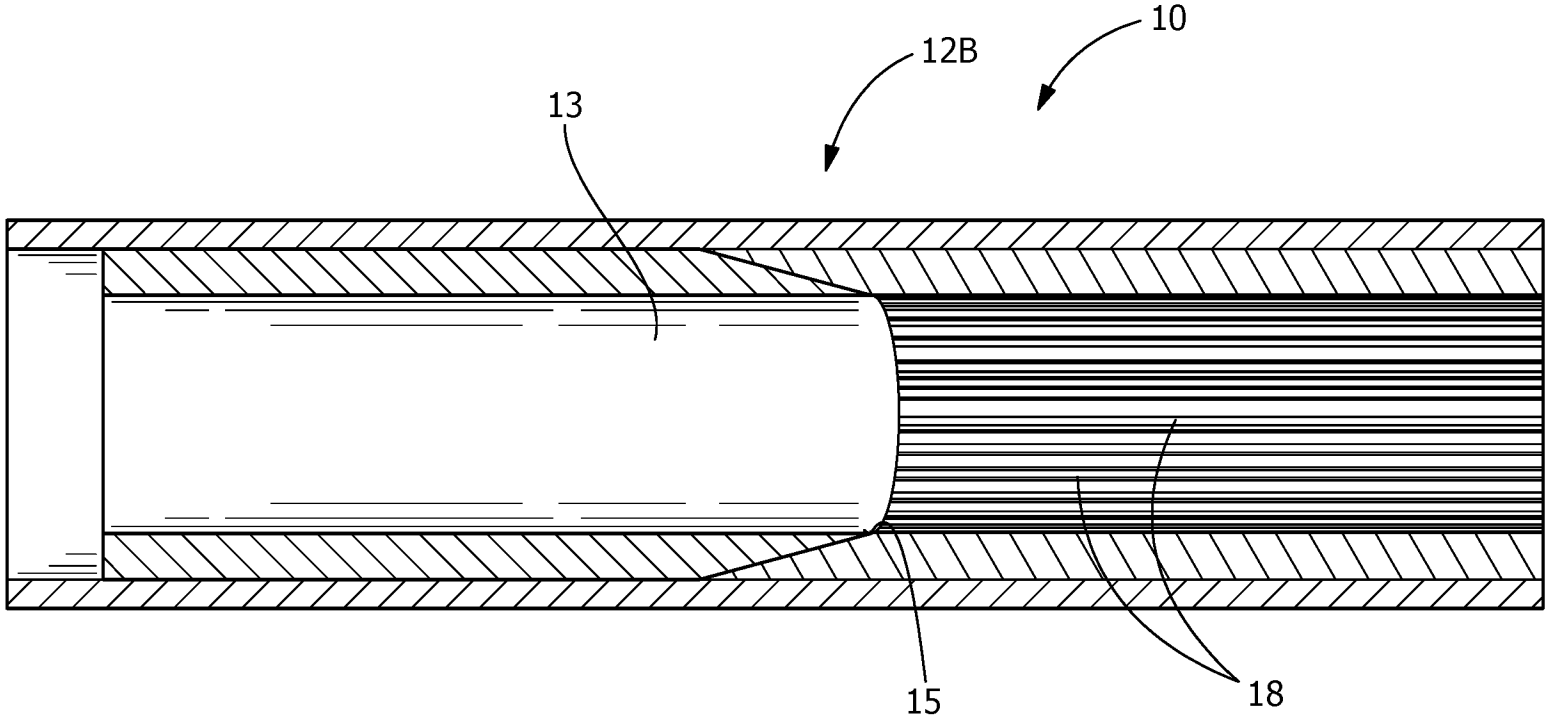
FIG. 2 is an axial cross section view of the wick to groove interface of a hybrid heat pipe with an interface in which the porous wick end section is a protrusion and the end of the groove section of the heat pipe is shaped to fit tightly around the protrusion of the wick.

FIG. 2 is an axial cross section view of hybrid heat pipe 10 as shown in FIG. 1 with alternative interface 12B in which the end section of porous wick 13 is protrusion 15 and the ends of grooves 18 are shaped to conform to and fit tightly around protrusion 15 of porous wick 13. One of the advantages of this design is that the porous wick presses tightly against the grooves when an interference fit between the porous wick and the evaporator section casing inner wall is used.

Figure 3:
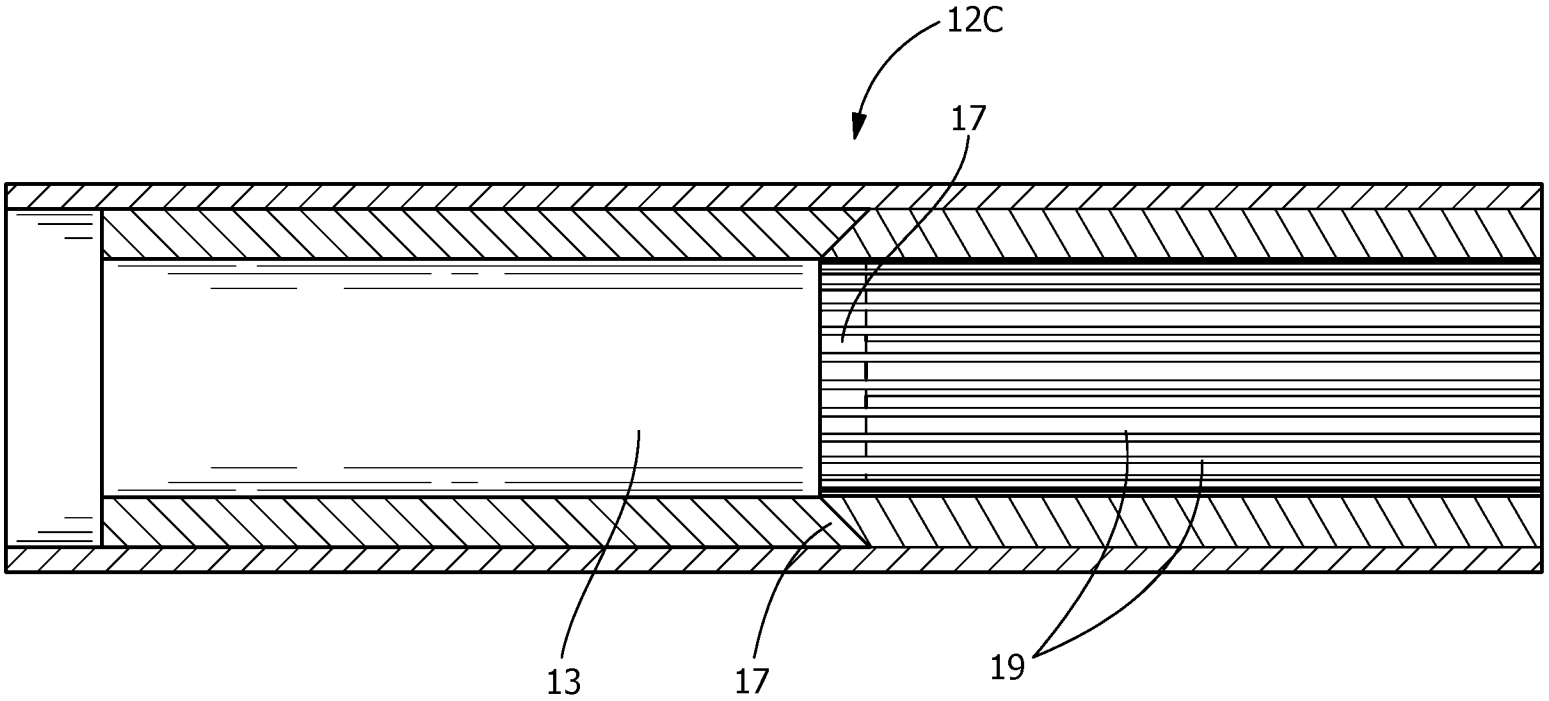
FIG. 3 is an axial cross section view of the wick to groove interface of a hybrid heat pipe with an interface in which the wick has a depression with sloped sides into which the end portion of the groove section of the heat pipe is shaped to tightly fit.

FIG. 3 is an axial cross section view of a hybrid heat pipe 10 as shown in FIG. 1 with alternative interface 12C in which wick 13 has sloped depression 17 into which the end portion of the groove section of the heat pipe is shaped to tightly fit. Grooves 18 are formed to allow them to slide into depression 17 in porous wick 13. In this case, the grooves can be sharpened to allow them to bite into wick 13, giving a good interface for fluid contact.

Figure 4:
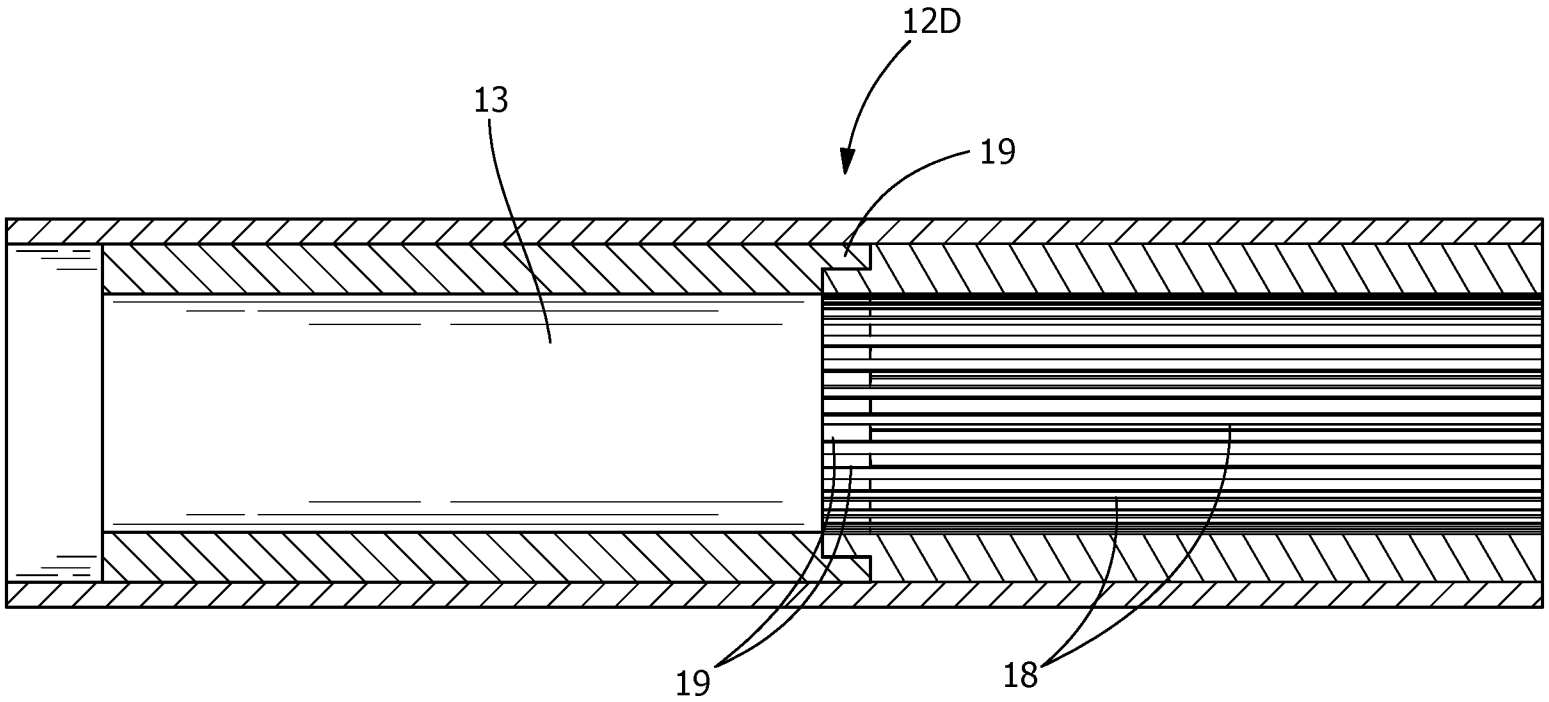
FIG. 4 is an axial cross section view of the wick to groove interface of a hybrid heat pipe with an interface in which the wick has a depression into which the end portion of the groove section of the heat pipe is shaped to tightly fit.

FIG. 4 is an axial cross section view of a hybrid heat pipe 10 as shown in FIG. 1 with alternative interface 12D in which wick 13 has a cylindrical depression 19 into which the end portion of grooves 18 are shaped to tightly fit. Grooves 18 are formed to allow them to slide into depression 19 in porous wick 13. The grooves in this configuration can also be sharpened to allow them to bite into porous wick 13, giving a good interface for fluid contact.

Figure 5:
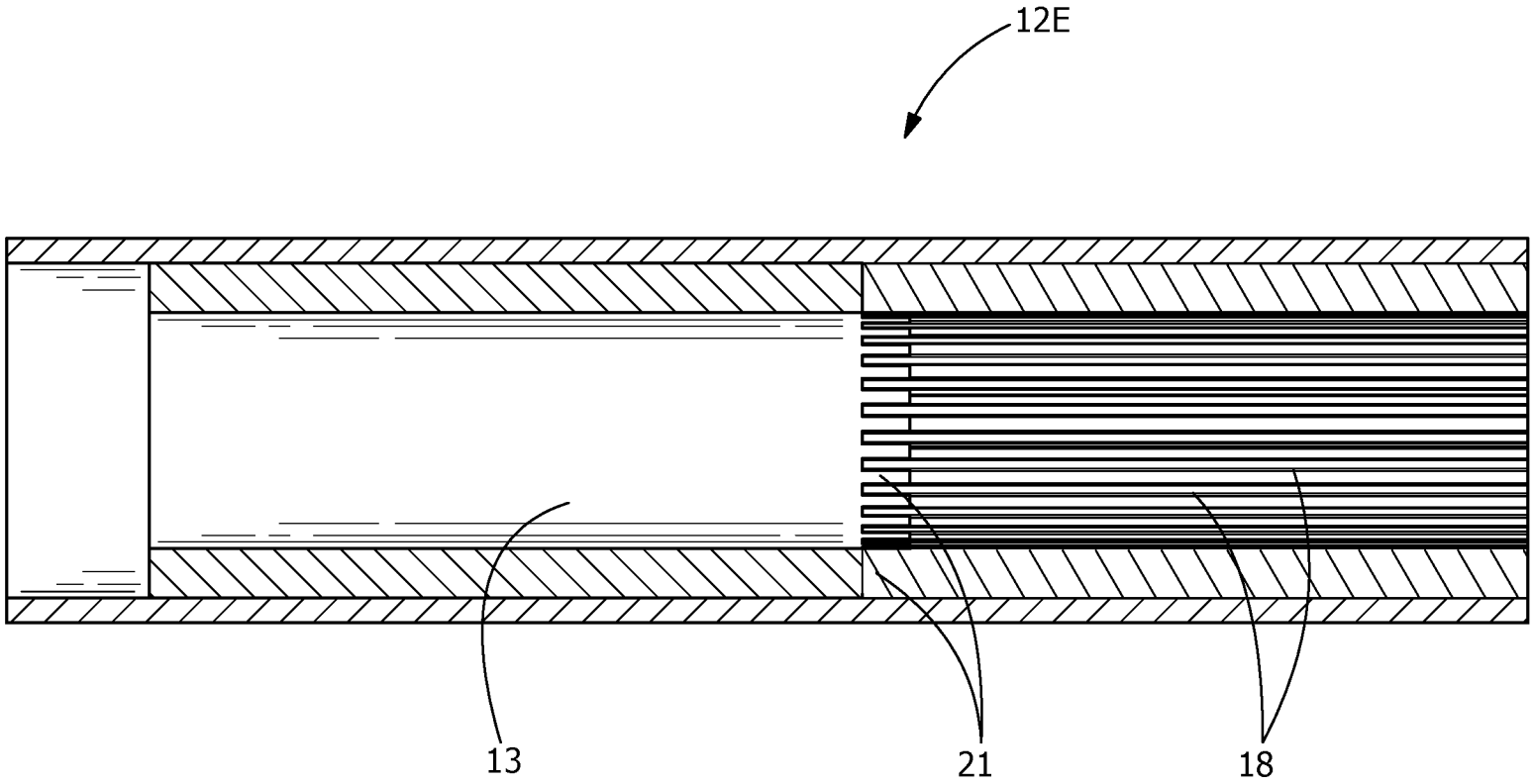
FIG. 5 is an axial cross section view of the wick to groove interface of a hybrid heat pipe with an interface in which the wick has finger-like protrusions that fit into the grooves.
Figure 6:
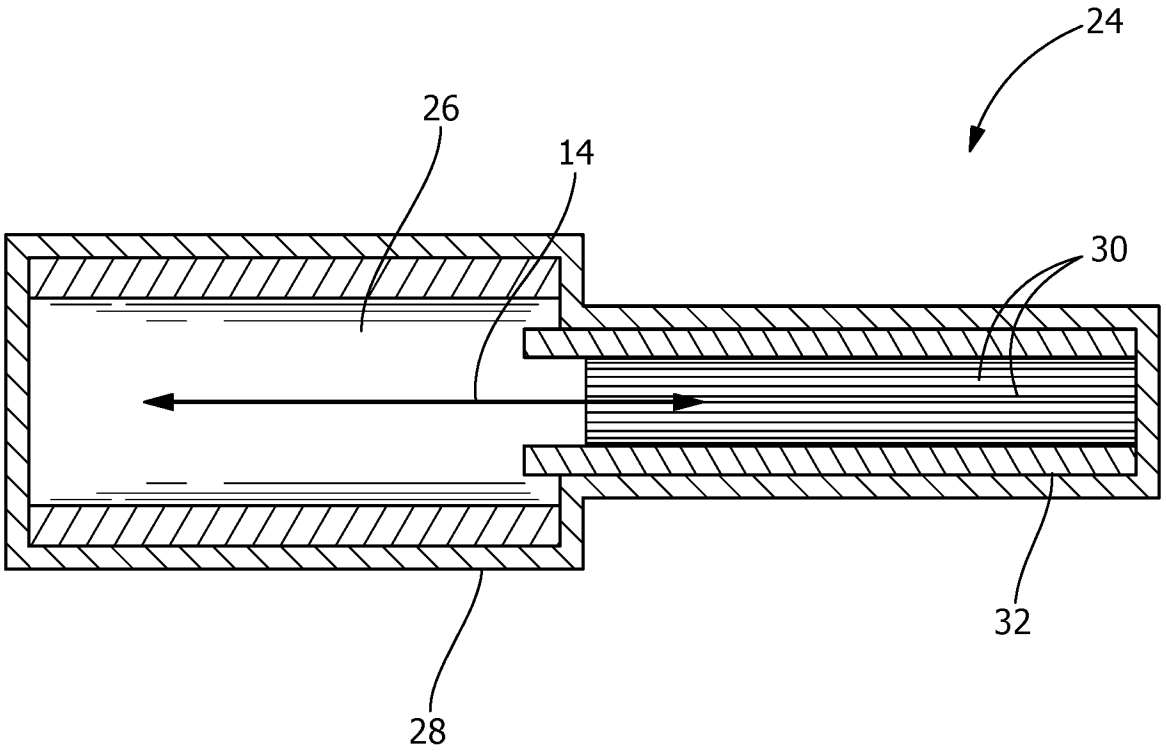
FIG. 6 is an axial cross section view of a hybrid heat pipe with a larger diameter casing in the evaporator section with porous wick than the diameter of the casing in the condenser section with capillary grooves, and with the porous wick protruding into the condenser section and fitting tightly against the grooves.

FIG. 5 is an axial cross section view of a hybrid heat pipe 10 as shown in FIG. 1 with alternative interface 12E in which wick 13 has finger-like protrusions 21 that fit into grooves 18. Protrusions 21 of wick 13 and the walls of grooves 18 can be formed to interlace with each other. While the remaining surfaces of interface 12E are shown as squared off as in FIG. 1, protrusions 21 can be formed on any of the interfaces discussed here FIG. 6 is an axial cross section view of hybrid heat pipe 24 with porous wick 26 in evaporator section 28 which has a larger diameter casing than the diameter of the casing in condenser section 32 with capillary grooves 30.

In this embodiment, porous wick 26 has more than one thickness (thinner at the axial groove interface and thicker within the main evaporator) to tailor the liquid pressure drop in the wick. The porous wick is designed to provide an interface with the grooves as well as the evaporator wall. Hybrid heat pipe 24 also includes open passage 14 for vapor along its axial length.

Conventional CCHPs have a constant internal diameter and geometry along their whole length. The type of wicks in the present invention can be used to allow larger (or smaller) diameter evaporators. This is a significant advantage because it allows the cross section of wick 26 to be increased. This feature allows the system to carry a higher power because it minimizes the liquid pressure drop in the lower permeability evaporator wick by providing a larger cross sectional area for fluid flow.

It is to be understood that the forms of this invention as shown are merely preferred embodiments. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. A hybrid heat pipe comprising:

a heat conductive casing;

an evaporator section with no grooves formed in a casing wall, the evaporator section having a separately formed porous wick inserted therein, the porous wick being deformed when positioned between the casing wall of the evaporator section as the porous wick has a larger outer diameter than an inner diameter of the evaporator section, the porous wick having axially extending depressions which extend from an end of the porous wick, the porous wick in thermal connection with the casing wall of the evaporator section;

a condenser section axially displaced from the evaporator section, the condenser section having no porous wick provided therein, the condenser section having capillary grooves formed in the casing wall of the heat conductive casing of the condenser section, the capillary grooves extend in a direction which is parallel to a longitudinal axis of the casing, the capillary groove having axially extending capillary groove ends which are shaped to conform to the depressions of the porous wick which extend from the end of the porous wick:

an interface section located between the evaporator section and the condenser section, the interface section having the depressions which extend from the end of the porous wick positioned in the capillary groove ends of the capillary grooves, the capillary groove ends of the capillary grooves grip the depressions extending from the ends of the porous wick to provide an interface which allows the transfer of condensed liquid axially from the capillary grooves to the porous wick.

2. The hybrid heat pipe of claim 1, wherein the depressions are sloped depressions.

3. The hybrid heat pipe of claim 1, wherein the depressions are cylindrical depressions.

4. The hybrid heat pipe of claim 1, wherein the depressions are finger-like protrusions.

5. The hybrid heat pipe of claim 1, wherein the capillary groove ends of the grooves are sharpened to bite into the depressions extending from the ends of the porous wick.

6. A hybrid heat pipe comprising:

a heat conductive casing;

an evaporator section with no grooves formed in a casing wall, the evaporator section having separately formed porous wick inserted therein, the porous wick being deformed when positioned between the casing wall of the evaporator section as the porous wick has a larger outer diameter than an inner diameter of the evaporator section, the porous wick having an evaporator section end with axially extending protrusions which extend from the an end of the porous wick, the porous wick in thermal connection with the casing wall of the evaporator section;

a condenser section axially displaced from the evaporator section, the condenser section having no porous wick provided therein, the condenser section having capillary grooves formed in the casing wall of the heat conductive casing of the condenser section, the capillary grooves extend in a direction which is parallel to a longitudinal axis of the casing, the capillary groove having axially extending capillary groove ends which are shaped to conform to the protrusions of the porous wick which extend from the end of the porous wick:

an interface section located between the evaporator section and the condenser section, the interface section having the protrusions which extend from the end of the porous wick positioned in the capillary groove ends of the capillary grooves, the capillary groove ends of the capillary grooves grip the protrusions which extend from the evaporator section ends of the porous wick to provide an interface which allows the transfer of condensed liquid from the capillary grooves to the porous wick; and the casing has a different diameter in the evaporator section containing the porous wick than the diameter of the casing in the condenser section with the capillary grooves.

* * * * *